US005754929A

United States Patent [19]

Nonomura et al.

[11] Patent Number: 5,754,929

[45] Date of Patent: May 19, 1998

[54] DEVELOPMENT APPARATUS

[75] Inventors: Makoto Nonomura; Tatsuya Tada, both of Yokohama; Isami Itoh, Kawasaki; Takeshi Yamamoto, Yokohama, all of Japan

[73] Assignee: Canon Kabushiki Kaisha, Tokyo, Japan

[21] Appl. No.: 748,615

[22] Filed: Nov. 13, 1996

[30] Foreign Application Priority Data

Nov. 15, 1995 [JP] Japan ..... 7-319818

[51] Int. Cl.[6] ..... G03G 15/09

[52] U.S. Cl. ..... 399/275; 399/272; 399/274

[58] Field of Search ..... 399/272, 274, 399/275, 277, 281, 282, 284

[56] References Cited

U.S. PATENT DOCUMENTS

| | | | |
|---|---|---|---|
| 2,874,063 | 2/1959 | Greig . | |
| 4,451,134 | 5/1984 | Fukuchi et al. | 399/274 |
| 4,464,041 | 8/1984 | Haneda et al. | 399/274 |
| 4,572,631 | 2/1986 | Kondo | 399/272 |
| 4,601,258 | 7/1986 | Kondoh | 399/272 |
| 4,624,559 | 11/1986 | Haneda et al. | 399/236 |
| 4,777,512 | 10/1988 | Takahashi et al. . | |
| 4,985,823 | 1/1991 | Tada et al. . | |
| 5,072,690 | 12/1991 | Ishikawa et al. | 399/275 |
| 5,227,848 | 7/1993 | Robinson et al. | 399/53 |
| 5,517,286 | 5/1996 | Tada et al. . | |
| 5,523,533 | 6/1996 | Itoh et al. . | |

FOREIGN PATENT DOCUMENTS

| | | |
|---|---|---|
| 54-043036 | 4/1979 | Japan . |
| 8-137255 | 5/1996 | Japan . |

*Primary Examiner*—Matthew S. Smith

*Attorney, Agent, or Firm*—Fitzpatrick, Cella, Harper & Scinto

[57] ABSTRACT

A development apparatus having a development sleeve for carrying and transporting a magnetic developer, a regulating roll for controlling the thickness of a layer of the developer on the development sleeve, a first magnetic pole provided in the development sleeve in the vicinity of a position of layer thickness control by the regulating roll, a second magnetic pole provided in the regulating roll to form a magnetic field for restraining the developer in cooperation with the first magnetic pole. The first and second magnetic poles are provided on the upstream side of a straight line connecting a center of the development sleeve and a center of the regulating roll in the direction of transport of the developer by the development sleeve so that the following inequalities are satisfied:

$$0<\theta\leqq\alpha/2,\ ,\ 0\leqq r\cdot\sin\phi<R\cdot\sin\theta$$

where $\alpha$ is an angle of a half-value width of a magnetic flux density distribution of the first magnetic pole; $\theta$ is an angle between the straight line and a line connecting the first magnetic pole and the center of the development sleeve; $\phi$ is an angle between the straight line and a line connecting the second magnetic pole and the center of the regulating roll; r is a radius of the regulating roll; and R is a radius of the development sleeve.

6 Claims, 16 Drawing Sheets

POSITIONAL RELATIONSHIP C

POSITIONAL RELATIONSHIP D

POSITIONAL RELATIONSHIP A

POSITIONAL RELATIONSHIP B

POSITIONAL RELATIONSHIP C

POSITIONAL RELATIONSHIP D

POSITIONAL RELATIONSHIP A

POSITIONAL RELATIONSHIP B

POSITIONAL RELATIONSHIP C

POSITIONAL RELATIONSHIP D

REGULATING
SLEEVE ;OUTSIDE DIAMETER 16mm
DEVELOPMENT
SLEEVE ;OUTSIDE DIAMETER 16mm

REGULATING
SLEEVE ;OUTSIDE DIAMETER 20mm
DEVELOPMENT
SLEEVE ;OUTSIDE DIAMETER 16mm

REGULATING
SLEEVE ;OUTSIDE DIAMETER 20mm
DEVELOPMENT
SLEEVE ;OUTSIDE DIAMETER 20mm

FIG. 17
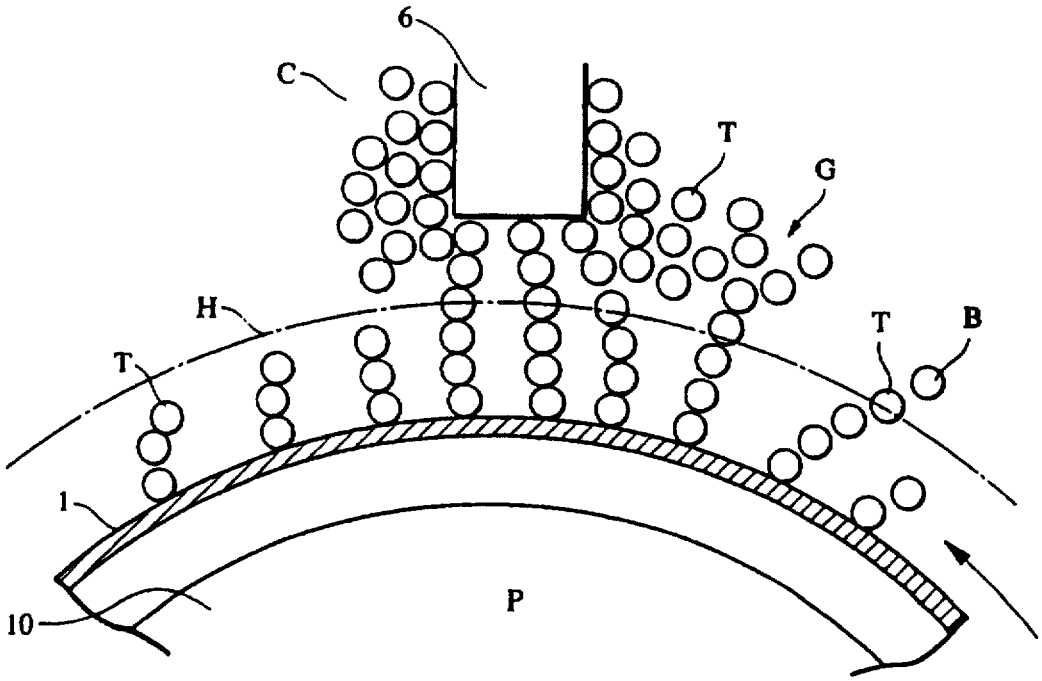
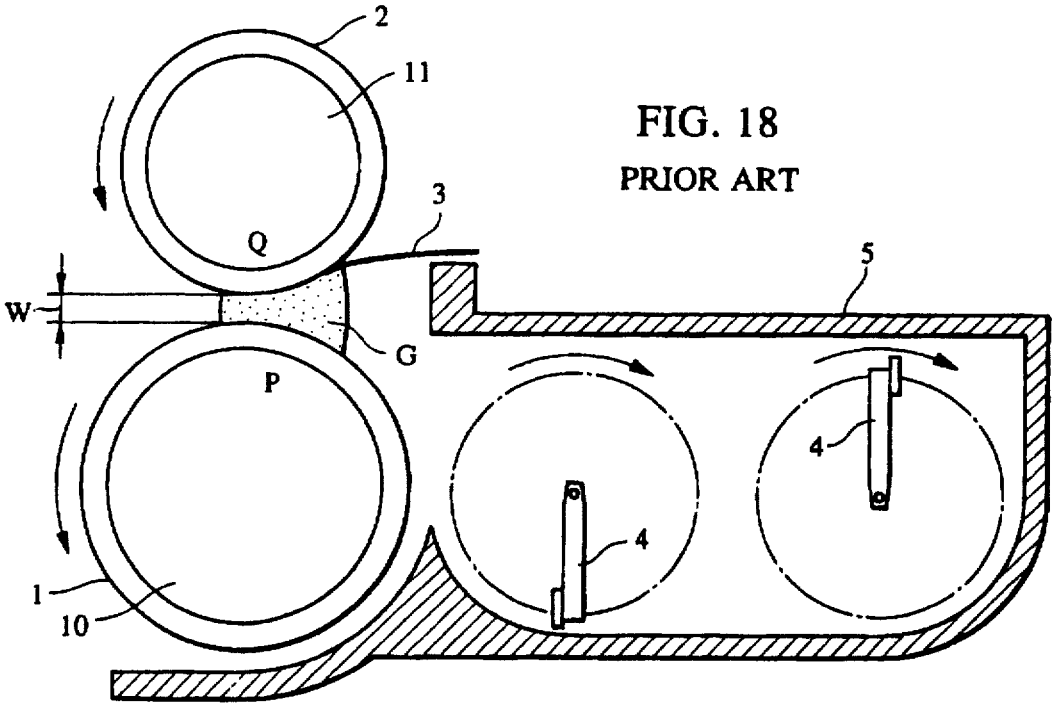
FIG. 18
PRIOR ART

DEVELOPMENT APPARATUS

BACKGROUND OF THE INVENTION

1. Field of the Invention

The present invention relates to a development apparatus for developing an electrostatic latent image used in an image forming apparatus such as an electrophotographic apparatus or electrostatic recording apparatus.

2. Description of the Related Art

Conventionally, a number of methods including a magnetic brush development method described in the specification of U.S. Pat. No. 2,874,063 have been proposed as development methods for electrophotographic image forming apparatuses. Among such methods, development methods using a one-component magnetic toner, i.e., a one-component developer without a carrier, are known. Japanese Patent Laid-Open Publication No. 43036/1979 discloses a development method of this kind which is known as a jumping development method, and which has already been put to practical use.

In this method, a magnetic toner on a development sleeve is controlled with a regulating member so as to be applied extremely thinly on the surface of the development sleeve. The magnetic toner is triboelectrically charged and is thereafter brought close to and opposed to an electrostatic latent image under the action of a magnetic field without contacting the electrostatic latent image, thus performing development. Great importance is attached to the method of supplying a toner with a necessary amount of triboelectric charge by applying the toner extremely thinly in order to increase chances of contact between the toner and the development sleeve.

FIG. 15 shows a magnetic cutting type development apparatus which is a conventional example of the apparatus based on the above-described development method. This development apparatus has a development case 5 containing a magnetic toner. In the development case 5 are provided a development sleeve 1 which carries the magnetic toner on its surface, a magnetic blade 6 for controlling the thickness of the toner layer carried on the development sleeve 1, and transport members 4 for agitating the toner and for supplying the toner to the development sleeve 1.

The development sleeve 1 is formed of a cylindrical nonmagnetic member which is mounted in an opening section of the development case 5 facing a photosensitive drum so as to be rotatable in the direction shown by the arrow. A permanent magnet 10 in the form of a roller is non-rotatably disposed inside the development sleeve 1. The magnetic blade 6 is disposed so that a spacing W is constantly maintained between the magnetic blade 6 and the development sleeve 1. Ordinarily, the spacing W is set within the range of 100 to 1000 μm.

Toner control in the above-described magnetic cutting type development apparatus will be described briefly. A magnetic pole P of the magnet 10 and the magnetic blade 6 are positioned generally in opposition to each other in correspondence with portions of the development sleeve 1 and magnetic blade 6 facing each other. The magnetic pole P and the magnetic blade 6 cooperate to form a magnetic field in which a region G, where the magnetic flux density is concentrated is formed between the portions of the development sleeve 1 and the magnetic blade 6 facing each other, as shown in FIG. 16. FIG. 17 shows an enlarged diagram of the region G.

Magnetic toner T on the development sleeve 1 is supplied from an inner section of the development case 5 by the transport members 4. Toner T is magnetized by the magnetic field of the permanent magnet 10, and trains of toner particles form toner spikes B by the magnetic interaction between the toner particles close to each other, as shown in FIG. 17. Each toner spike B is transported into the region G to receive a magnetic restraining force. That is, the magnetic flux density-concentrated region G functions as a toner restraining region. The restrained toner T receives an electric charge by being triboelectrically charged by friction with the rotating development sleeve 1.

The triboelectrically charged toner T receives an image force from the development sleeve 1 through the charge retained on the development sleeve 1. The retained toner receives a transport force caused by the rotation of the development sleeve 1 in the same direction as the direction of this rotation. Each toner spike B is torn apart at a position in the region G at which this toner transport force prevails over the magnetic force of restraining the toner, that is, at a position along a cutting line H which extends along the circumference of the development sleeve 1 between the development sleeve 1 and the magnetic blade 6, as indicated by the dot-dash line, so that only a portion of the toner spike B on the development sleeve 1 remains on the development sleeve 1. As the development sleeve 1 rotates, the toner remaining on the development sleeve 1 escapes from the region G and spreads over the development sleeve 1 as a thin layer.

If the size of toner particles is reduced to meet a recent demand for high-quality image formation, the strength of magnetization per toner particle becomes smaller and there is a possibility of a reduction in the magnetic restraining force acting on the toner in the above-described magnetic cutting type apparatus. In such a situation, a portion of the toner that is not sufficiently charged may escape from the restraint in the region G to leak onto the development sleeve 1. On the other hand, a portion of the toner that is not sufficiently charged may accumulate in the vicinity of the magnetic blade 6. If a mass of accumulated toner C that is not sufficiently charged becomes large, the magnetic restraining force in the region G acting on some portion of the mass of accumulated toner C may be so small that some portion of the toner that is not sufficiently charged in the mass of accumulated toner C can depart from the mass C to leak onto the development sleeve 1.

As described above, in the magnetic cutting type apparatus, it is possible that a portion of the toner that is not sufficiently charged will leak out onto the development sleeve 1 by passing the restraining region G resulting in failure to achieve suitable image forming performance.

In view of these problems, the inventors of the present invention have invented a development apparatus in which a portion of a magnetic toner that is not sufficiently charged is returned to an inner section of a development case by applying a reverse transport force to the toner with a rotating developer regulation member to prevent the toner that is not sufficiently charged from passing the restraining region G and leaking out onto a development sleeve while enabling a portion of the toner that is sufficiently charged to be selectively applied to the surface of the development sleeve.

This development apparatus is constructed as shown in FIG. 18. That is, the magnetic blade of the above-described magnetic cutting type apparatus is replaced with a regulating sleeve 2 formed of a nonmagnetic member and a permanent magnet 11 accommodated in the regulating sleeve 2. The regulating sleeve 2 is rotatably disposed in the vicinity of the development sleeve 1. The magnet 11 in the regulating sleeve 2 is positioned so that its magnetic pole Q is generally in opposition to the magnetic pole P of the magnet 10 provided in the development sleeve 10. A scraper 3 is also provided which contacts the regulating sleeve 2.

The regulating sleeve 2 is opposed to the development sleeve 1 with a certain spacing W set therebetween. The regulating sleeve 2 and the development sleeve 1 move in opposite directions relative to each other at the opposed position, that is, the regulating sleeve 2 rotates in the direction opposite to the direction of toner transport by the development sleeve 1. The magnet 11 in the regulating sleeve 2 and the magnet 10 in the development sleeve 1 cooperate to form, between portions of the regulating sleeve 2 and the development sleeve 1 facing each other, a toner restraining region G in which the magnetic flux density is concentrated, as in the above-described magnetic cutting type development apparatus.

A magnetic toner supplied onto the development sleeve 1 from the development case 5 by the toner transport members 4 is magnetically restrained in the above-described region G and receives electric charge by triboelectric charging with the development sleeve 1. The charged toner is restrained on the development sleeve 1 by an image force received through the charge, and receives a transport force caused by the rotation of the development sleeve 1 and is transported along the direction of this rotation. Simultaneously, the toner magnetically restrained in the region G is also restrained on the regulating sleeve 2 by the magnetic force from the magnetic pole Q of the magnet 11 of the regulating sleeve 2. As a result of the regulating sleeve 2 rotating, the toner receives a transport force (reverse transport force) therefrom in such a direction as to be returned to an inner section of the development case 5.

A portion of the toner that is sufficiently charged in the restraining region G receives a large transport force in the direction of rotation of the development sleeve 1 which prevails over the reverse transport force that the toner receives from the regulating sleeve 2, and that acts to return the toner in the direction toward the development case 5. Therefore, the toner that is sufficiently charged can escape from the restraining region G to be applied on the development sleeve 1 so as to form a thin layer. On the other hand, a portion of the toner that is not sufficiently charged receives a smaller transport force in the direction of rotation of the development sleeve 1 and is returned to an inner section of the development case 5 by the reverse transport force that it receives from the regulating sleeve 2. Thus, the toner that is sufficiently charged is selectively applied on the development sleeve 1 and transported to the development area.

As described above, a regulating sleeve 2 accommodating a magnet and rotating in the reverse direction of the development sleeve 1 is provided as a toner regulation member of a development apparatus to apply a reverse transport force to a toner, thus achieving the effect of restraining a portion of the toner that is not sufficiently charged from escaping from the restraining region G and leaking onto the development sleeve 1 while selectively enabling a portion of the toner that is sufficiently charged to escape from the restraining region G to be applied on the development sleeve 1.

In the above-described conventional apparatus arranged to apply transport forces to a restrained developer by development sleeve 1 and regulating sleeve 2, however, charging the magnetic toner in the region G and selectively applying a sufficiently charged portion of the toner may be incompatible with each other when a certain positional relationship or combination of the magnetic poles of the magnet 10 in the development sleeve 1 and the magnet 11 in the regulating sleeve 2 cooperating to form the magnetic field in the restraining region G is selected. There is a possibility of failure to stabilize the application of the toner on the development sleeve or to suitably restrain the toner that is not sufficiently charged from escaping the region G and leaking onto the development sleeve.

If the toner particle size is reduced to meet a demand for high-quality image formation as mentioned above, the amount of charge per toner particle may be increased to such an extent as to cause electrostatic cohesion or the like between toner particles, so that it is difficult to uniformly charge the toner or to apply the toner on the development sleeve 1 so as to form a uniform thin toner layer.

SUMMARY OF THE INVENTION

In view of these circumstances, an object of the present invention is to provide a development apparatus capable of charging a magnetic developer to a high level.

Another object of the present invention is to provide a development apparatus capable of selectively applying a sufficiently charged developer on a developer carrier.

To achieve these objects, according to the present invention, there is provided a development apparatus comprising a developer carrier member for carrying and transporting a magnetic developer, a regulating rotary member for controlling the thickness of a layer of the developer on the developer carrier member, a first magnetic pole provided in the developer carrier member in the vicinity of a regulating portion of the regulating rotary member, and a second magnetic pole provided in the regulating rotary member to form a magnetic field for restraining the developer in cooperation with the first magnetic pole, wherein the first and second magnetic poles are positioned on the upstream side of a straight line connecting a center of the developer carrier member and a center of the regulating rotary member in the direction of transport of the developer by the developer carrier member so that the following inequalities are satisfied:

$$0<\theta\leqq\alpha/2$$

$$0\leqq r\cdot\sin\phi<R\cdot\sin\theta$$

where $\alpha$ is an angle of a half-value width of a magnetic flux density distribution of the first magnetic pole; $\theta$ is an angle between a line connecting the first magnetic pole and the center of the developer carrier member and the straight line connecting the centers of the developer carrier member and the regulating rotary member; $\phi$ is an angle between a line connecting the second magnetic pole and the center of the regulating rotary member and the straight line connecting the centers of the developer carrier member and the regulating rotary member; r is a radius of the regulating rotary member; and R is a radius of the developer carrier member.

These and other objects, features, and advantages of the present invention will become apparent from the following detailed description of preferred embodiments thereof with reference to the accompanying drawings.

BRIEF DESCRIPTION OF THE DRAWINGS

FIG. 3(*b*) and FIGS. 4(*a*) and 4(*b*) are diagrams each showing the relationship between magnetic pole N1 of the magnet in the development sleeve and magnetic pole S1 of the magnet in the regulating sleeve placed in unsuitable positions;

FIG. 7(*b*) and FIGS. 8(*a*) and 8(*b*) are diagrams each showing the relationship between magnetic pole N1 of the magnet in the development sleeve and magnetic pole S1 of the magnet in the regulating sleeve placed in unsuitable positions;

FIG. 12(*b*) and FIGS. 13(*a*) and 13(*b*) are diagrams each showing the relationship between magnetic pole N1 of the magnet in the development sleeve and magnetic pole S1 of the magnet in the regulating sleeve placed in unsuitable positions;

FIG. 17 is an enlarged diagram showing the facing portions of the development sleeve and the regulating blade of the development apparatus shown in FIG. 15; and FIG. 18 is a schematic diagram showing the construction of another conventional development apparatus.

DESCRIPTION OF THE PREFERRED EMBODIMENTS

Embodiments of the present invention will be described in detail with reference to the accompanying drawings.

(Embodiment 1)

Figure 1:
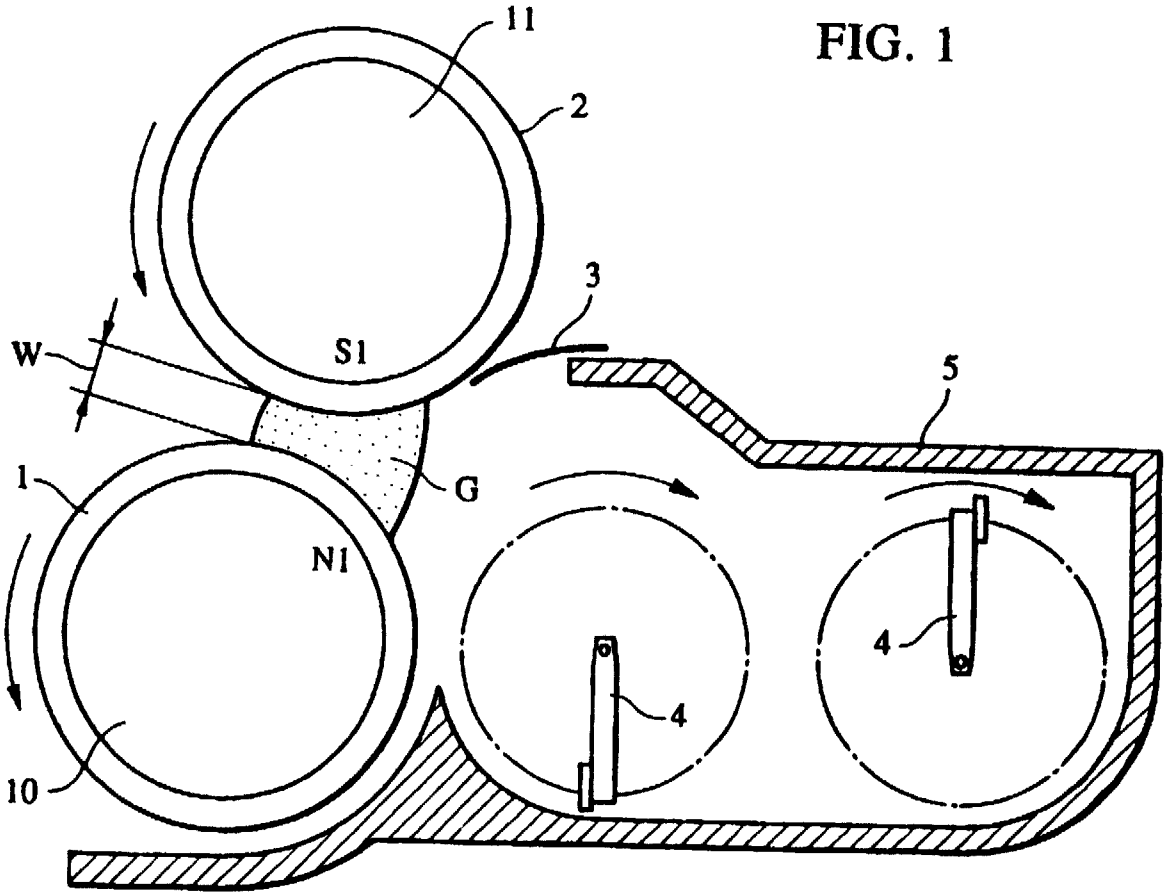
FIG. 1 is a schematic diagram showing the construction of a development apparatus which represents an embodiment of the present invention.

FIG. 1 schematically shows the construction of a development apparatus which represents an embodiment of the present invention. This development apparatus has a development case 5 containing a magnetic toner. A development sleeve 1, a regulating sleeve 2, a scraper 3 and transport members 4 are provided in the development case 5.

In this embodiment, the development sleeve 1 is formed of a non-magnetic cylinder having an outside diameter of 32 mm. A permanent magnet 10 in the form of a roller is disposed inside the development sleeve 1. The magnet 10 has six magnetic poles along the circumferential direction: a magnetic pole N1 positioned in the vicinity of a portion of the development sleeve 1 facing the regulating sleeve 2 and other five magnetic poles (not shown). The regulating sleeve 2 is formed of a nonmagnetic cylinder having an outside diameter of 32 mm equal to that of the development sleeve 1, and is opposed to the development sleeve 1 with a spacing W set therebetween. A permanent magnet 11 in the form of a roller is disposed inside the regulating sleeve 2. This magnet 11 has two magnetic poles: a magnetic pole S1 positioned in the vicinity of a portion of the regulating sleeve 2 facing the development sleeve 1 and another magnetic pole (not shown).

The magnets 10 and 11 have magnetic poles N1 and S1 with different polarities in the vicinity of portions of the development sleeve 1 and the regulating sleeve 2 facing each other, as described above, and these magnetic poles cooperate to form a magnetic field in which a toner restraining region G where lines of magnetic force are concentrated is formed along the facing portions.

The magnetic toner supplied onto the development sleeve 1 from the development case 5 by the transport members 4 is magnetically restrained in the region G and receives an electric charge by being triboelectrically charged due to friction with the development sleeve 1. The charged toner receives an image force through the charge retained on the development sleeve 1. With the development sleeve 1 rotating, the toner receives a transport force therefrom in the direction of rotation of the development sleeve 1. Simultaneously, the toner magnetically restrained in the region G is also restrained on the regulating sleeve 2 by the magnetic force of the magnetic pole S1 of the magnet 11 of the regulating sleeve 2. With the regulating sleeve 2 rotating, the toner receives a transport force therefrom in such a direction as to be returned to an inner section of the development case 5.

That is, two forces are applied to the toner restrained in the region G: the transport force in the direction of rotation of the development sleeve 1 through the image force due to the charge in the toner, and the reverse transport force of the restraint by the magnetic force received from the regulating sleeve 2 and acting to return the toner to an inner section of the development case 5. A portion of the toner sufficiently charged can have the transport force prevailing over the reverse transport force of returning the toner to an inner section of the development case 5. Only the portion of the toner sufficiently charged can pass through the restraining region to be applied on the development sleeve 1 and transported to the development area. A portion of the toner that is not sufficiently charged is returned to an inner section of the development case 5 by the reverse transport force received from the regulating sleeve 2.

A feature of this development apparatus resides in that the magnetic pole N1 of the magnet 10 and the magnetic pole S1 of the magnet 11 cooperating to produce the magnetic field forming the restraining region G are placed in a particular positional relationship with each other so that charging the magnetic toner and selectively applying a sufficiently charged portion of the toner on the development sleeve 1 will be compatible with each other.

Figure 2:
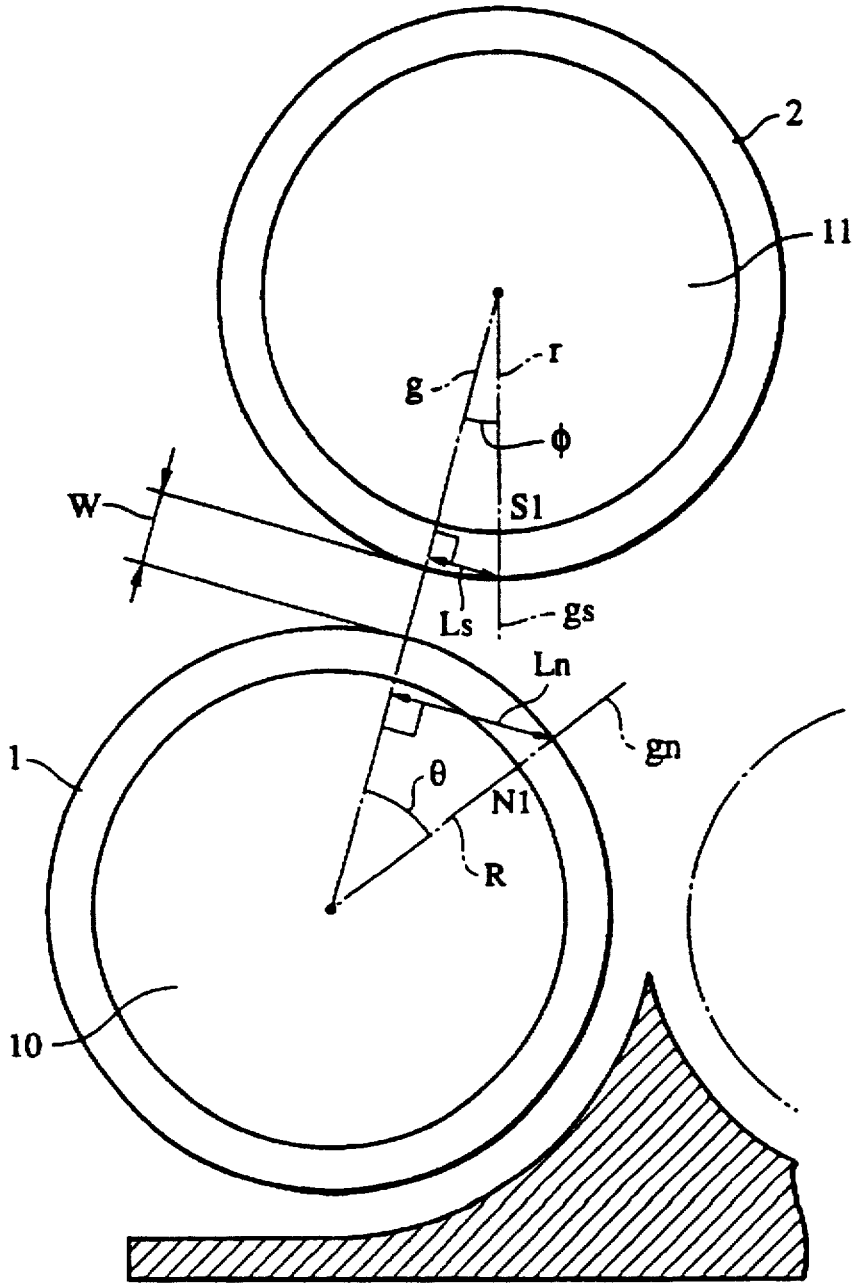
FIG. 2 is a diagram showing optimal disposition of a magnet in a development sleeve and a magnet in a regulating sleeve in the development apparatus shown in FIG. 1.

As shown in FIG. 2, a straight line g connects the center of the development sleeve 1 and the center of the regulating sleeve 2 (corresponding to the centers of magnets 10 and 11, respectively), a straight line gn is assumed to extend from the center of the development sleeve 1 and to pass through the magnetic pole N1, and a straight line gs is assumed to extend from the center of the regulating sleeve 2 and to pass through the magnetic pole S1. The position of the magnetic pole N1 is represented by an angle θ between the straight lines g and gn while the position of the magnetic pole S1 is represented by an angle ϕ between the straight lines g and gs (the direction of each angle from the straight line g toward an inner section of the development case 5 being taken to be positive).

Studies made by the inventors to achieve the present invention show that charging the magnetic toner in the restraining region G requires that the magnetic pole N1 be positioned so that, if the angle of a half-value width of a magnetic density distribution of the magnetic pole N1 is α, the angle θ is limited within the range expressed by the following inequality:

$$0<\theta\leqq\alpha/2 \quad (1)$$

If the magnetic pole N1 is positioned such that θ>α/2, it cannot suitably cooperate with the magnetic pole S1 to form a magnetic field strong enough to form the restraining region G. If θ≦0, the magnetic pole N1 is positioned on the downstream side of the position of opposition to the regulating sleeve 2 in the developer transport direction, so that the toner transported to the restraining region G is returned to an inner section of the development case 5 by the reverse transport force from the regulating sleeve 2 before being triboelectrically charged by friction with the development sleeve 1, resulting in failure to apply the toner on the development sleeve 1.

In this development apparatus, therefore, the magnetic pole N1 is positioned so that inequality (1): 0<θ≦α/2 is satisfied.

Also, if the radii of the development sleeve 1 and the regulating sleeve 2 are R and r, respectively, the magnetic pole S1 of this development apparatus is positioned so that the angle ϕ representing the position of the magnetic pole S1 satisfies an inequality (2) shown below so that charging the magnetic toner and selectively applying the sufficiently charged toner on the development sleeve 1 will be compatible with each other in the restraining region G.

$$0<r\cdot\sin\phi\leqq R\cdot\sin\theta \quad (2)$$

A magnet with a magnetic pole N1 having a magnetic flux density of 1000 gauss and a half-value width α of 40° was employed as magnet 10, and a magnet with a magnetic pole S1 having a magnetic flux density of 1000 gauss and a half-value width α of 30° was employed as magnet 11.

To stably form the toner restraining region G, it is desirable to set the magnetic flux density of each of the magnetic poles N1 and S1 to 600 gauss or higher. Most preferably, at least one of the magnetic poles N1 and S1 has a magnetic flux density of 800 gauss or higher. If the magnetic flux density is lower than 600 gauss, a magnetic flux sufficient for restraining the toner cannot be formed. This results in failure to sufficiently charge the toner or to prevent a portion of the toner that is not sufficiently charged from leaking out.

Two developer or magnetic toners formed of toner materials on the market and having volume-average particle sizes of 9 μm and 6.5 μm were used.

Figure 3A:
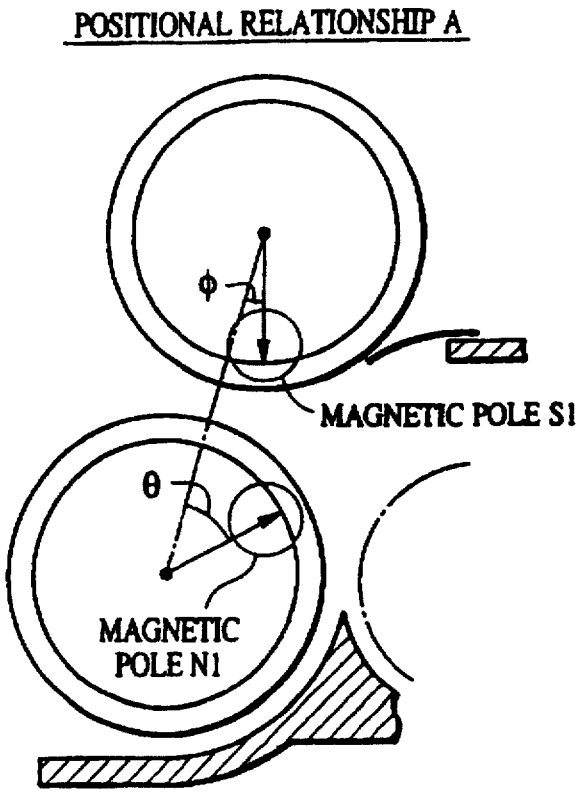
FIG. 3(*a*) is a diagram showing the relationship between magnetic pole N1 of the magnet in the development sleeve and magnetic pole S1 of the magnet in the regulating sleeve placed in optimal positions.
Figure 3B:
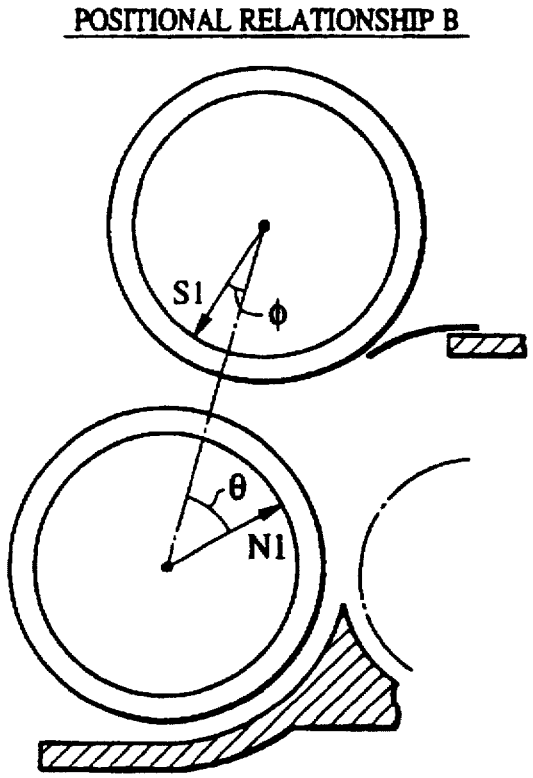

FIG. 3(*a*) shows the relationship between the positions of the magnetic pole N1 and the magnetic pole S1 in this development apparatus, and FIGS. 3(*b*), 4(*a*), and 4(*b*) show other positional relationships as comparative examples. Table 1 shows applied states of the toner and the performance of charging the toner examined with respect to these positional relationships.

In the upper segments of the four evaluation spaces corresponding to each positional relationship, the results of evaluation with respect to use of the toner having a volume-average particle size of 9 μm are shown. In the lower segments of the evaluation spaces, the results of evaluation with respect to use of the toner having a volume-average particle size of 6.5 μm are shown. In the evaluation of the applied state of the toner, a state of being applied so as to form a thin uniform layer is indicated as ○ while a state of being unevenly applied or applied so as not to form the desired thin uniform layer is indicated as X.

Figure 15:
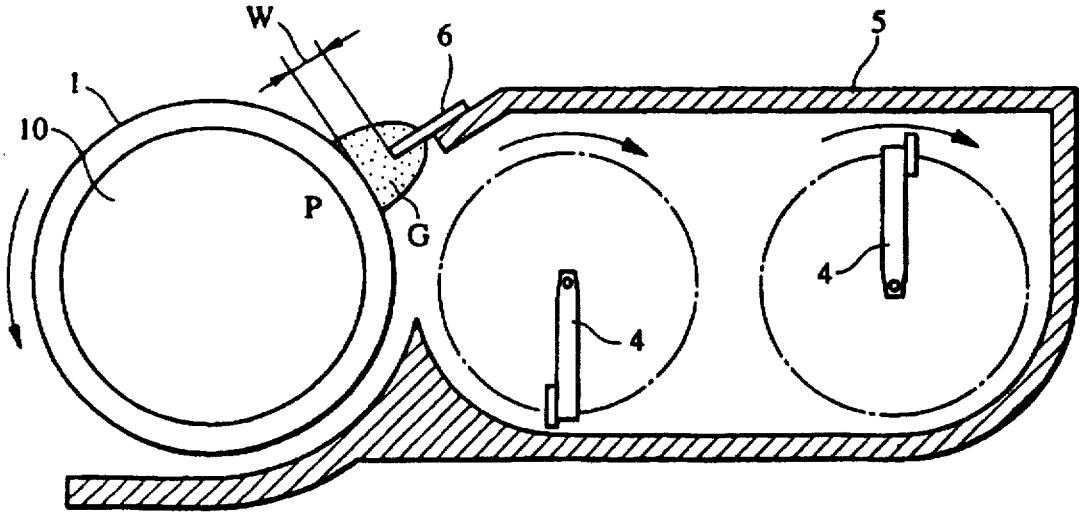
FIG. 15 PRIOR ART
FIG. 15 is a schematic diagram showing the construction of a conventional development apparatus.
Figure 16:
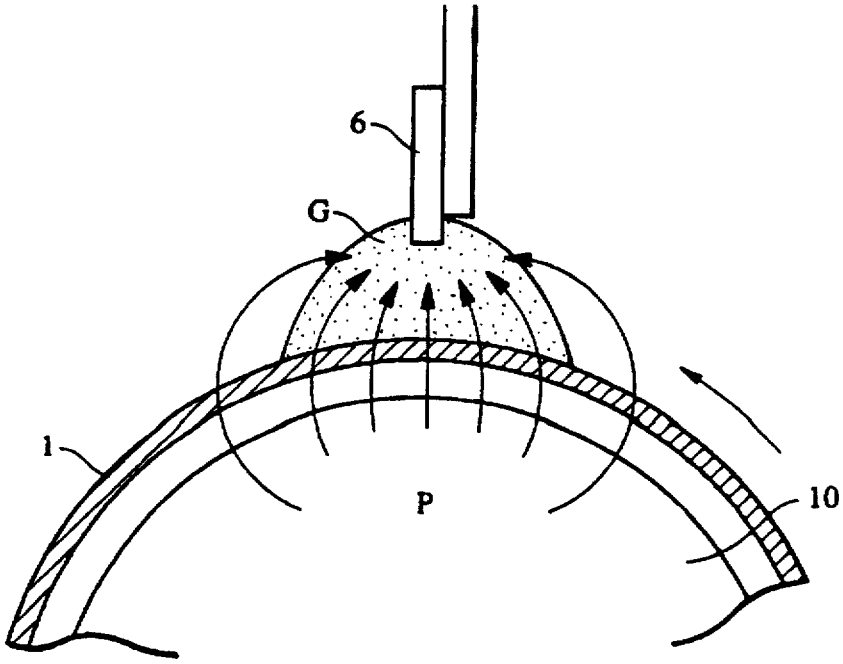
FIG. 16 is a diagram showing portions of a development sleeve and a regulating blade facing each other in the development apparatus shown in FIG. 15.

The performance of charging the toner was evaluated in terms of inverse toner rate of the toner applied on the development sleeve 1. The inverse toner rate is a rate at which a portion of the toner charged with the polarity opposite to the desired polarity is distributed. The studies made by the inventors of the present invention also show that, if the inverse toner rate is lower, the proportions of a portion of the toner not sufficiently charged and ineffective in development and a portion of the toner reversely charged, which may cause "fog" in a background portion of an output image, in the applied toner are reduced to enable suitable image formation. Assuming that the inverse toner rate of each of the same toners applied on the development sleeve 1 of a magnetic cutting type development apparatus such as that shown in FIG. 15 is 1, values smaller than 1, then values about 1 and values larger than 1 of the inverse toner rate of the toners obtained with respect to the above-mentioned positional relationships are represented by ○, Δ and X, respectively. The inverse toner rate was measured with a powder charge distribution measuring apparatus "E-spart analyzer" (manufactured by Hosokawa Micron).

TABLE 1

| | Positional Relationship between Magnetic Poles N1 and S1 | Charged State of Toner | Applied State of Toner |
|---|---|---|---|
| A | $0 < r\cdot\sin\phi \leqq R\cdot\sin\theta$ | ○ | ○ |
| | $\theta \leqq \alpha/2$ | ○ | ○ |
| B | $r\cdot\sin\phi < 0 \leqq R\cdot\sin\theta$ | Δ | x |
| | $\theta \leqq \alpha/2$ | x | x |
| C | $0 \leqq R\cdot\sin\theta < r\cdot\sin\phi$ | Δ | ○ |
| | $\theta \leqq \alpha/2$ | Δ | x |
| D | $0 \leqq r\cdot\sin\phi \leqq R\cdot\sin\theta$ | x | ○ |
| | $\alpha/2 < \theta$ | x | x |

(Evaluation Spaces)

Upper Spaces: Evaluation with respect to use of the toner having a volume-average particle size of 9 μm Lower Spaces: Evaluation with respect to use of the toner having a volume-average particle size of 6.5 μm The positional relationship A shown in FIG. 3(*a*) set in this development apparatus is such that the magnetic pole N1 is positioned so that the angle θ is within the range of ½ of the angle α of the magnetic pole N1 half-value width, and such that the magnetic poles N1 and S1 are positioned on the upstream side of the facing positions of the development sleeve 1 and the regulating sleeve 2 in the toner transport direction but the magnetic pole S1 is positioned downstream relative to the magnetic pole N1.

In the case where the positional relationship A was established, the toner was suitably charged and was applied so as to form a thin uniform layer, as shown in Table 1. The following is thought to explain this effect. That is, the magnetic field formed by cooperation of the magnetic poles N1 and S1 is optimized by the positional relationship A, so that the toner can be restrained strongly enough to be suitably charged, and so that the transport forces to the restrained toner from the development sleeve 1 and the regulating sleeve 2 are suitably balanced to selectively apply the toner. Thus, certain compatibility is accomplished between charging the toner and selectively applying the sufficiently-charged toner on the development sleeve.

The positional relationship B shown in FIG. 3(*b*) is a comparative example which differs from the positional relationship A in that the magnetic pole S1 is positioned on the downstream side of the opposed portions of the development sleeve 1 and the regulating sleeve 2 in the toner transport direction.

In the case where the positional relationship B was established, the toner was applied considerably unevenly and a portion of the toner that is not sufficiently charged was also applied on the development sleeve 1, as shown in Table 1. With respect to this, it is thought that, since the magnetic pole S1 is positioned on the downstream side of the opposed portions, the restraint of the toner decreases abruptly in a downstream portion of the formed restraining region G thereby failing to restrain a part of the toner from leaking onto the development sleeve 1. Therefore, it is desirable to position the magnetic pole S1 on the upstream side of the opposed portions.

Figure 4A:
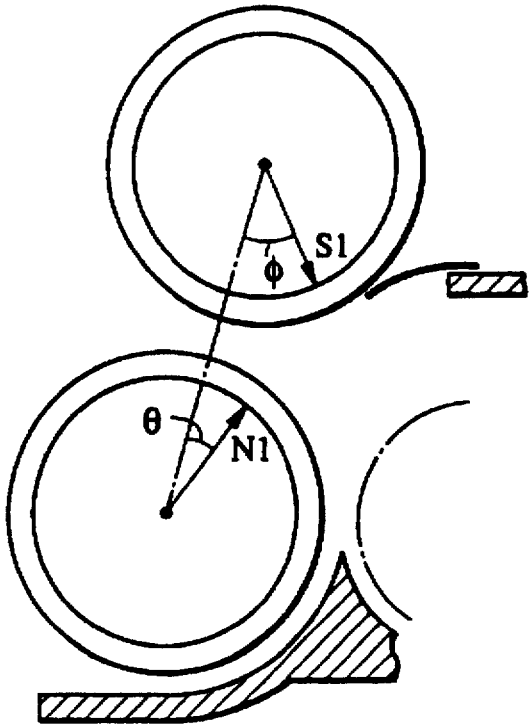
Figure 4B:
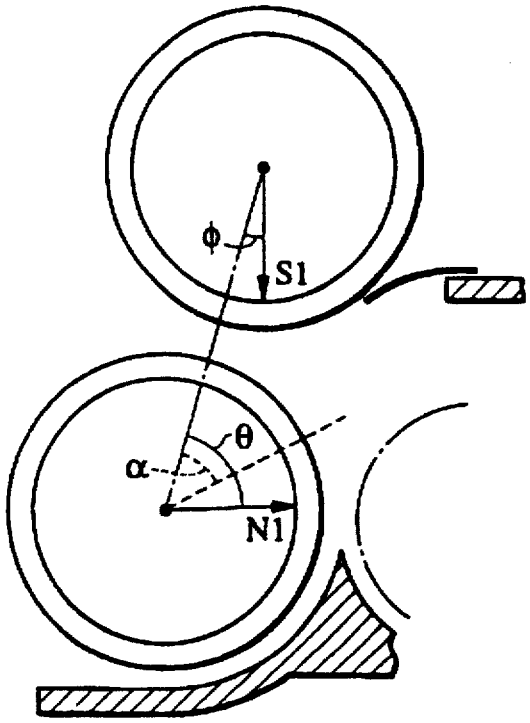

The positional relationship C shown in FIG. 4(*a*) is a comparative example in which the positions of the magnetic poles N1 and S1 in the positional relationship A are reversed to set the magnetic pole S1 upstream relative to the magnetic pole N1.

In the case where the positional relationship C was established, a good application result was obtained when the toner having a volume-average particle size of 9 μm was used, but the amount of toner applied was small and a part of the applied toner was not sufficiently charged, as shown in Table 1. When the toner having a volume-average particle size of 6.5 μm was used, a deterioration in the applied state such as variation or non-uniformity of the toner application rate was observed. With respect to this, it is thought that the reverse transport force acting on the toner is so strong in an upstream portion of the restraining region G that the toner is returned in the direction toward an inner section of the development case 5 before being sufficiently charged triboelectrically by friction with the surface of the development sleeve 1, resulting in a reduction in the amount of applied toner as well as failure to sufficiently charge the toner. It is also thought that the deterioration in the applied state observed in the case where toner having smaller particle size was used was due to the influence of a reduction in the saturated magnetization or an increase in the amount of charge per toner particle, as mentioned above.

The positional relationship D shown in FIG. 4(*b*) is a comparative example which differs from the positional relationship A in that the magnetic pole N1 is positioned so that the angle θ is outside the range of ½ of the angle α of the magnetic pole N1 half-value width. In the case where the positional relationship D was established, a good application result was obtained when the toner having a volume-average particle size of 9 μm was used. However, the amount of toner applied was small, the stability of application was low and a substantially large part of the applied toner was not sufficiently charged, as shown in Table 1. When the toner having a volume-average particle size of 6.5 μm was used, deterioration of each of the performance of charging the toner and the applied state of the toner occurred. This is because the magnetic pole N1 cannot suitably cooperate with the magnetic pole S1 to form a magnetic field strong enough to form the restraining region G, as mentioned above. Also, it is thought that the deterioration in the applied state observed in the case where the toner smaller in particle size was used was due to the influence of a reduction in the saturated magnetization or an increase in the amount of charge per toner particle, as mentioned above. Therefore, it is desirable to position the magnetic pole N1 so that the angle θ is within the range of ½ of the angle α of the magnetic pole N1 half-value width.

As described above, in this development apparatus, the magnetic pole N1 is positioned at the angle θ satisfying inequality (1):

$$0<\theta\leqq\alpha/2 \quad (1)$$

while the magnetic pole S1 is positioned at the angle φ satisfying inequality (2):

$$0<r\cdot\sin\phi\leqq R\cdot\sin\theta. \quad (2)$$

The magnetic field formed by the magnetic poles N1 and S1 in cooperation with each other is thereby optimized, so that charging the magnetic toner and selectively applying the sufficiently-charged toner on the development sleeve 1 are compatible with each other in the restraining region G.

This development apparatus was also tested by setting the outside diameter of each of the development sleeve 1 and the regulating sleeve 2 to 20 mm. Also in this case, when the magnetic poles N1 and S1 were positioned in the same manner as described above, the magnetic field formed by the magnetic poles N1 and S1 in cooperation with each other was optimized, so that charging the magnetic toner in the restraining region G and selectively applying the sufficiently charged toner on the development sleeve 1 are compatible with each other.

(Embodiment 2)

Figure 5:
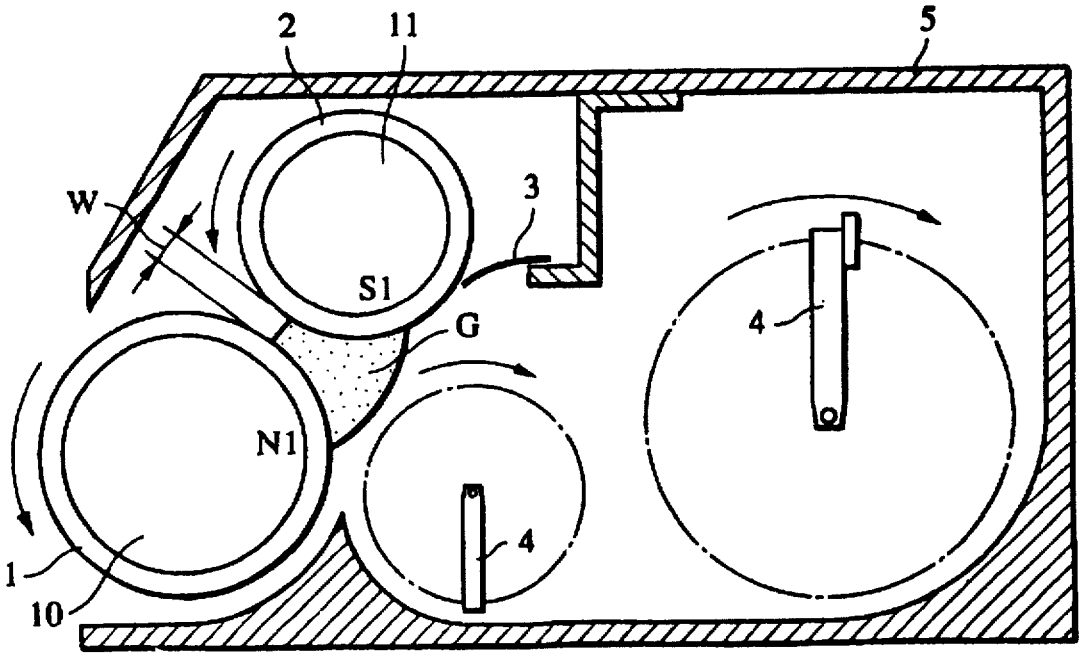
FIG. 5 is a schematic diagram showing the construction of another embodiment of the present invention.
Figure 6:
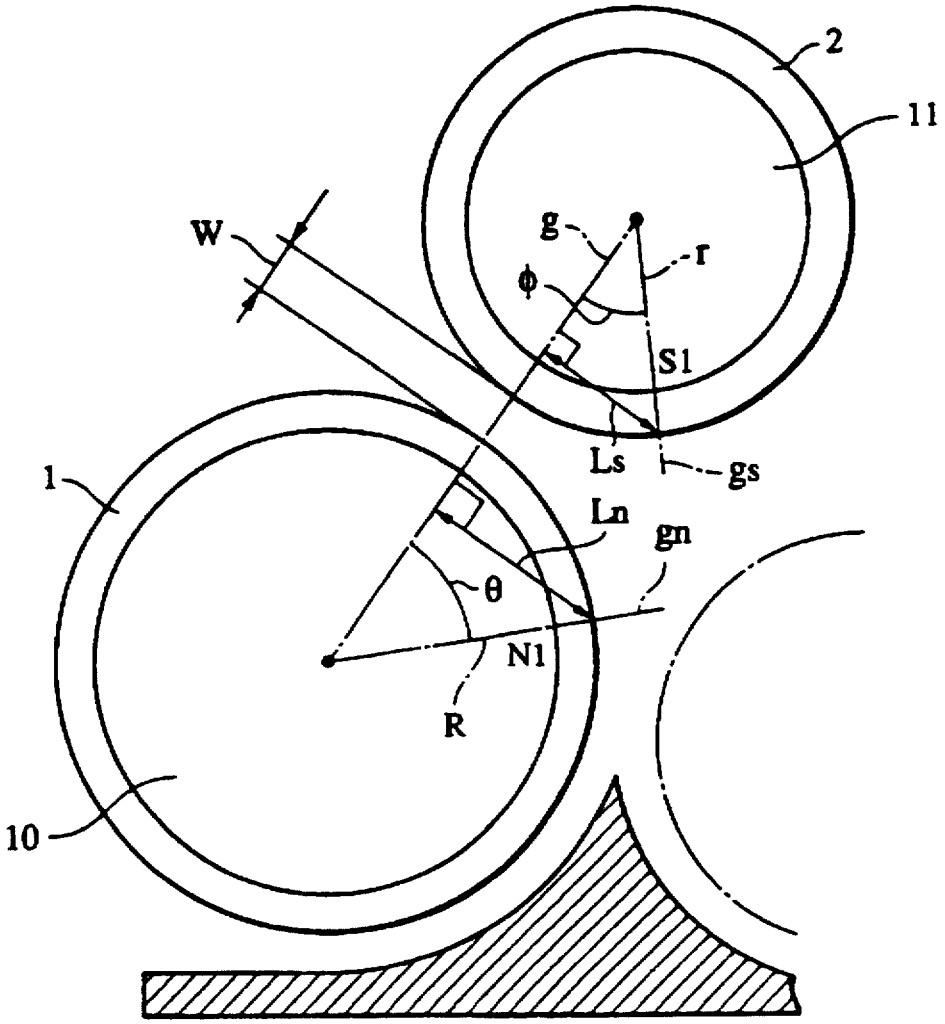
FIG. 6 is a diagram showing optimal disposition of the magnet in the development sleeve and the magnet in the regulating sleeve in the development apparatus shown in FIG. 5.

FIG. 5 is a schematic diagram showing the construction of a development apparatus which represents a second embodiment of the present invention, and FIG. 6 is a diagram for explaining optimal magnetic pole disposition of a magnet in the development sleeve 1 and a magnet in the regulating sleeve 2 in the development apparatus shown in FIG. 5.

The development apparatus of this embodiment is characterized in that a regulating sleeve 2 is smaller in diameter than a development sleeve 1, and that a magnetic pole N1 of a magnet 10 and a magnetic pole S1 of a magnet 11 cooperating to produce a magnetic field forming a restraining region G are placed in a particular positional relationship with each other in order that charging a magnetic toner and selectively applying a sufficiently charged portion of the toner on the development sleeve 1 be compatible with each other in the restraining region G. In other respects, the construction of this apparatus is the same as that of Embodiment 1 shown in FIG. 1.

This development apparatus was tested with respect to three combinations of development sleeve 1 and regulating sleeve 2.

A combination of a development sleeve 1 having an outside diameter of 20 mm and a regulating sleeve 2 having an outside diameter of 16 mm is provided as "Combination 1", a combination of a development sleeve 1 having an outside diameter of 32 mm and a regulating sleeve 2 having an outside diameter of 20 mm is provided as "Combination 2", and a combination of a development sleeve 1 having an outside diameter of 32 mm and a regulating sleeve 2 having an outside diameter of 16 mm is provided as "Combination 3".

The magnet 10 in the development sleeve 1 has four poles consisting of the magnetic pole N1 positioned in the vicinity of a portion of the development sleeve 1 facing the regulating sleeve 2 and other three magnetic poles (not shown). The magnet 11 in the regulating sleeve 2 has two poles consisting of the magnetic pole S1 positioned in the vicinity of a portion of the regulating sleeve 2 facing the development sleeve 1 and another magnetic pole (not shown).

A magnet with a magnetic pole N1 having a magnetic flux density of 1000 gauss and a half-value width $\alpha$ of 60° was employed as magnet 10, and a magnet with a magnetic pole S1 having a magnetic flux density of 800 gauss and a half-value width $\alpha$ of 40° was employed as magnet 11.

A developer or magnetic toner formed of toner materials on the market and having a volume-average particle size of 6.5 μm was used.

In this development apparatus, the magnetic pole N1 is positioned so that at the angle $\theta$ is within the range expressed by inequality (1): $0<\theta\leqq\alpha/2$ for the reason described below. If the magnetic pole N1 is positioned so that $\theta>\alpha/2$, the magnetic pole N1 cannot suitably cooperate with the magnetic pole S1 to form a magnetic field enough to form the restraining region G. If $\theta\leqq 0$, the magnetic pole N1 is positioned on the downstream side of the position of opposition to the regulating sleeve 2 in the developer transport direction, so that the toner transported to the restraining region G is returned to an inner section of the development case 5 by the reverse transport force from the regulating sleeve before being triboelectrically charged by friction with the development sleeve 1, resulting in failure to apply the toner on the development sleeve 1.

Referring to FIG. 6, if the distance between the straight line g and the point at which the straight line gn extending from the center of the development sleeve 1 intersects the surface of the development sleeve 1 is Ln; the distance between the straight line g and the point at which the straight line gs extending from the center of the regulating sleeve 2 intersects the surface of the regulating sleeve 2 is Ls; the radius of the development sleeve is R; and the radius of the regulating sleeve 2 is r, then Ln and Ls are expressed as $Ln=R\cdot\sin\theta$, $Ls=r\cdot\sin\phi$.

In this development apparatus, in order for charging the magnetic toner and selectively applying a part of the sufficiently charged magnetic toner on the development sleeve 1 to be compatible with each other in the restraining region G, the magnetic pole S1 is positioned so that the distances Ln and Ls satisfy $(0\leqq)\ Ls\leqq Ln$, that is, the magnetic pole S1 is positioned at the angle $\phi$ satisfying the following inequality (2):

$$0<r\cdot\sin\phi\leqq R\cdot\sin\theta \qquad (2)$$

Figure 7A:
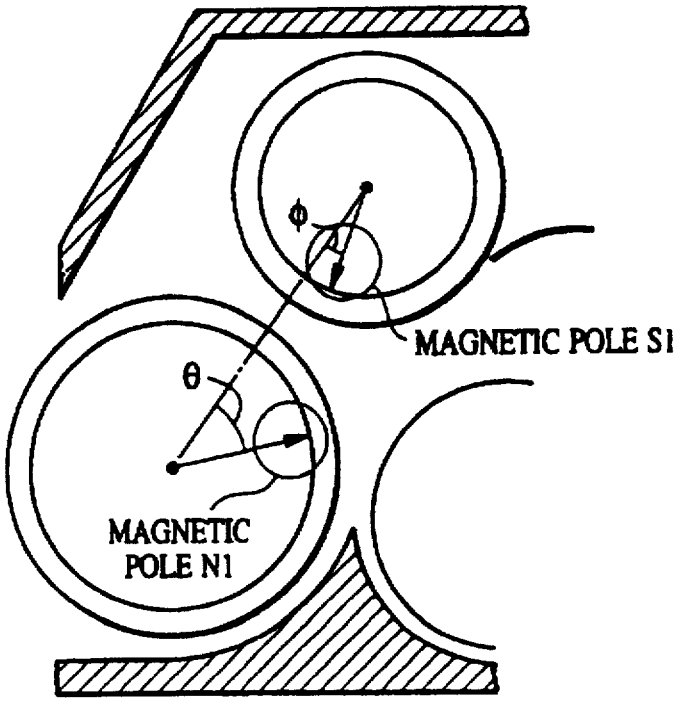
FIG. 7(*a*) is a diagram showing the relationship between magnetic pole N1 of the magnet in the development sleeve and magnetic pole S1 of the magnet in the regulating sleeve placed in optimal positions.
Figure 7B:
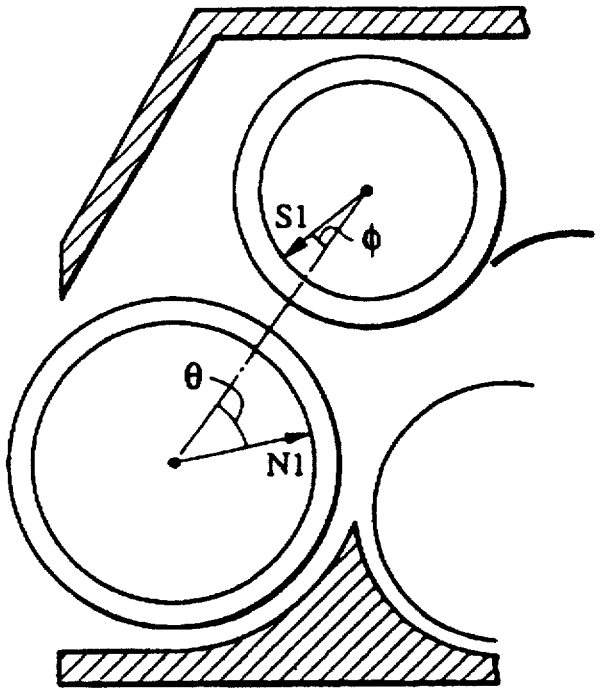

FIG. 7(*a*) shows the relationship between the positions of the magnetic pole N1 and the magnetic pole S1 in this development apparatus, and FIGS. 7(*b*), 8(*a*), and 8(*b*) show other positional relationships as comparative examples.

The positional relationship A shown in FIG. 7(*a*) set in this development apparatus is such that the magnetic pole N1 is positioned so that the angle $\theta$ is within the range of ½ of the angle $\alpha$ of the magnetic pole N1 half-value width, and such that the magnetic poles N1 and S1 are positioned on the upstream side of the opposed portions of the development sleeve 1 and the regulating sleeve 2 in the toner transport direction but the magnetic pole S1 is positioned downstream relative to the magnetic pole N1.

The positional relationship B shown in FIG. 7(*b*) is a comparative example which differs from the positional relationship A in that the magnetic pole S1 is positioned on the downstream side of the opposed portions of the development sleeve 1 and the regulating sleeve 2 in the toner transport direction.

In the case where the positional relationship B was established, both the performance of charging the toner and the applied state of the toner were unsatisfactory. With respect to this result, it is thought that, since the magnetic pole S1 is positioned on the downstream side of the opposed portions, restraint of the toner decreases abruptly in a downstream portion of the formed restraining region G thereby failing to restrain a portion of the toner from leaking onto the development sleeve 1.

Figure 8A:
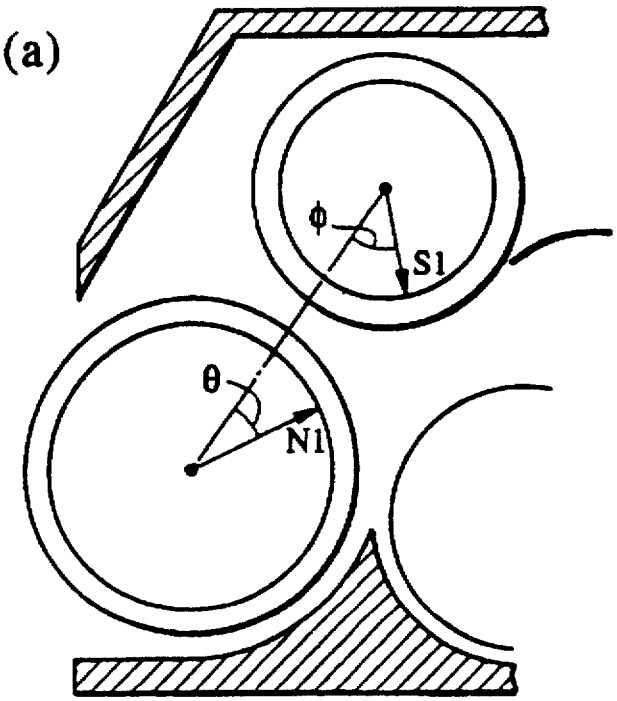
Figure 8B:
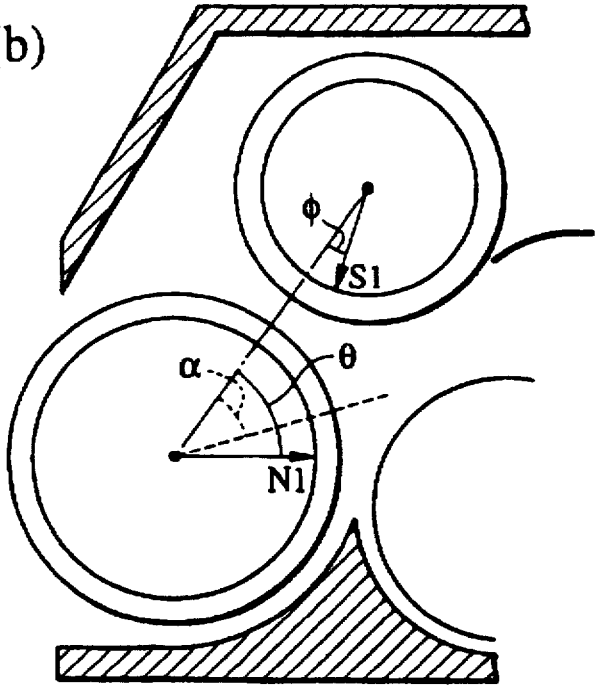

The positional relationship C shown in FIG. 8(*a*) is a comparative example in which the positions of the magnetic poles N1 and S1 in the positional relationship A are reversed to set the magnetic pole S1 upstream relative to the magnetic pole N1. In the case where the positional relationship C was established, both the performance of charging the toner and the applied state of the toner were unsatisfactory. With respect to this, it is thought that the reverse transport force acting on the toner is so strong in an upstream portion of the restraining region G that the toner is returned in the direction toward an inner section of the development case 5 before being sufficiently charged triboelectrically by friction with the surface of the development sleeve 1, resulting in a reduction in the amount of applied toner as well as failure to sufficiently charge the toner.

The positional relationship D shown in FIG. 8(*b*) is a comparative example which differs from the positional relationship A in that the magnetic pole N1 is positioned so that the angle $\theta$ is outside the range of ½ of the angle $\alpha$ of the magnetic pole N1 half-value width. In the case where the positional relationship D was established, both the performance of charging the toner and the applied state of the toner were unsatisfactory for the same reason as described above.

Figure 9:
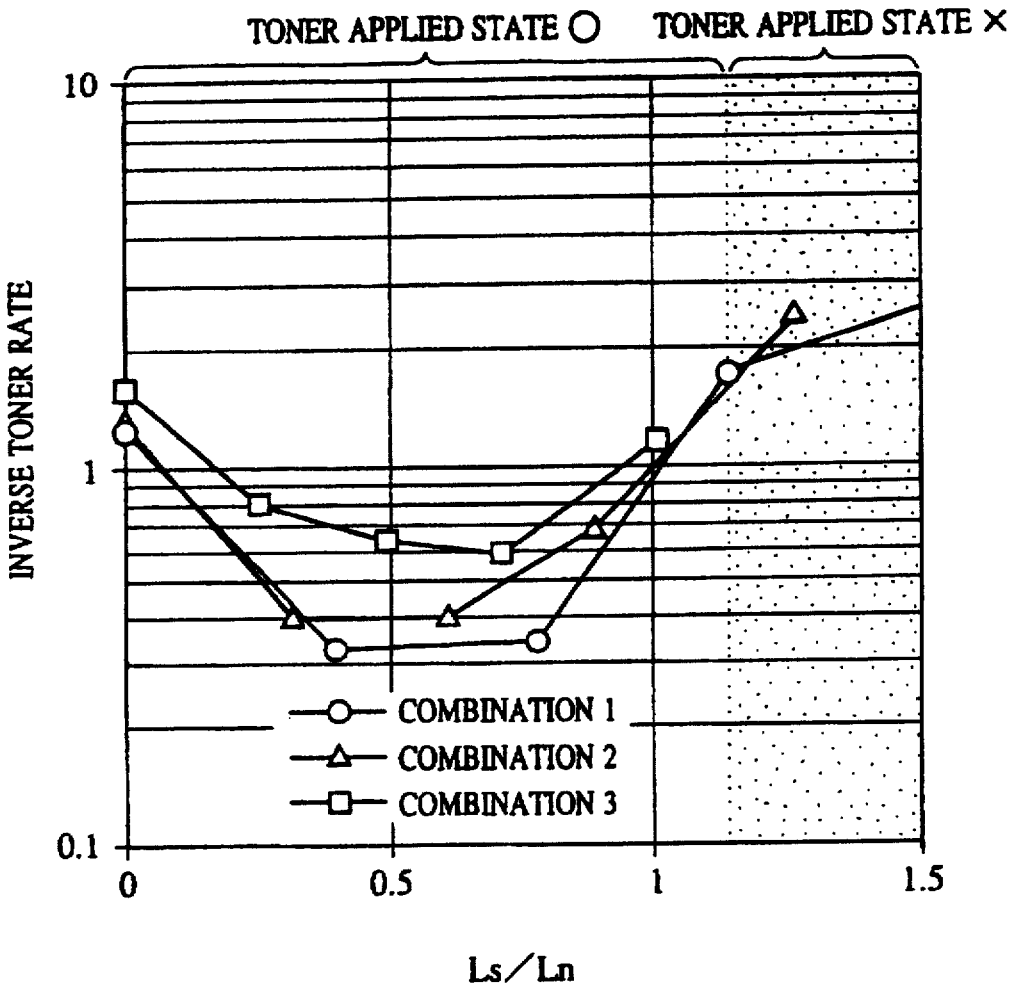
FIG. 9 is a diagram showing the relationship between the distance Ln of magnetic pole N1 from a straight line connecting the centers of the development sleeve and the regulating sleeve, the distance Ls of magnetic pole Ls, the applied state of a toner, and the inverse toner rate of the applied toner.

FIG. 9 shows the relationship between the distances Ln and Ls, the applied state of the toner and the inverse toner rate of the applied toner with respect to positional relationships A and C in each of the above-mentioned "Combination 1", "Combination 2, and "Combination 3".

In FIG. 9, the abscissa represents the ratio of Ls and Ln when the magnetic pole N1 is positioned so that the above-mentioned inequality (1): $0<\theta\leqq\alpha/2$ is satisfied and when the distance Ln is constant. That is, $0\leqq Ls/Ln\leqq 1$ represents the positional relationship A in which the magnetic pole S1 is positioned downstream relative to the magnetic pole N1 while $Ls/Ln>1$ represents the positional relationship C in which the magnetic pole S1 is positioned upstream relative to the magnetic pole N1. The ordinate represents the inverse toner rate relative to the inverse toner rate of the same toner applied on the development sleeve 1 in the magnetic cutting type development apparatus shown in FIG. 15, which is assumed to be 1. In FIG. 9, the dotted area represents a toner application region that is defective.

As shown in FIG. 9, in the case where the positional relationship A was established, the inverse toner rate was generally smaller than 1 and the applied state was satisfactory. It is thought that the magnetic field formed by cooperation of the magnetic poles N1 and S1 is optimized by the positional relationship A, so that the toner can be restrained strongly enough to be suitably charged, and so that the transport forces to the restrained toner from the development sleeve 1 and the regulating sleeve 2 are suitably balanced to selectively apply the toner. Thus, certain compatibility is accomplished between charging the toner and selectively applying the sufficiently charged toner on the development sleeve.

In contrast, in the case where the positional relationship C was established, the inverse toner rate was higher than 1 and the applied state was unsatisfactory.

As described above, in this development apparatus, the magnetic pole N1 is positioned at the angle θ satisfying inequality (1):

$$0<\theta\leqq\alpha/2 \quad (1)$$

while the magnetic pole S1 is positioned at the angle ϕ satisfying inequality (2):

$$0<r\cdot\sin\phi\leqq R\cdot\sin\theta. \quad (2)$$

The magnetic field formed by the magnetic poles N1 and S1 in cooperation with each other is thereby optimized, so that charging the magnetic toner and selectively applying the sufficiently-charged toner on the development sleeve 1 are compatible with each other in the restraining region G.

Further, the regulating sleeve 2 is reduced in diameter relative to the development sleeve 1 to extend the life of the development apparatus, as explained below.

A part of the toner not sufficiently charged and returned in the direction toward an inner section of the development cases by the reverse transport force from the regulating sleeve 2 after being transported to the restraining region G is carried on the surface of the regulating sleeve 2 by the magnetic field of the magnet 11 in the regulating sleeve 2. This part of the toner is scraped off by the scraper 3 in contact with the regulating sleeve 2 to fall into the case 5. If the diameter of the regulating sleeve 2 is reduced as in this development apparatus, the radius of curvature at the position of contact with the scraper 3 becomes smaller, so that the toner can be separated from the regulating sleeve 2 more easily.

In such a case, therefore, the desired toner scraping performance can be maintained even if the contact pressure of the scraper 3 is reduced. Consequently, damage to the toner due to the load at the position of contact with the scraper can be reduced, thereby limiting deterioration of the toner and achieving an increase in life. Also, if the contact pressure of the toner is reduced, the drive torque of the regulating sleeve 2 can be reduced.

Alternatively, if the diameter of the regulating sleeve 2 is reduced relative to that of the development sleeve 1, the size and the manufacturing cost of the development apparatus can be reduced.

(Embodiment 3)

Figure 10:
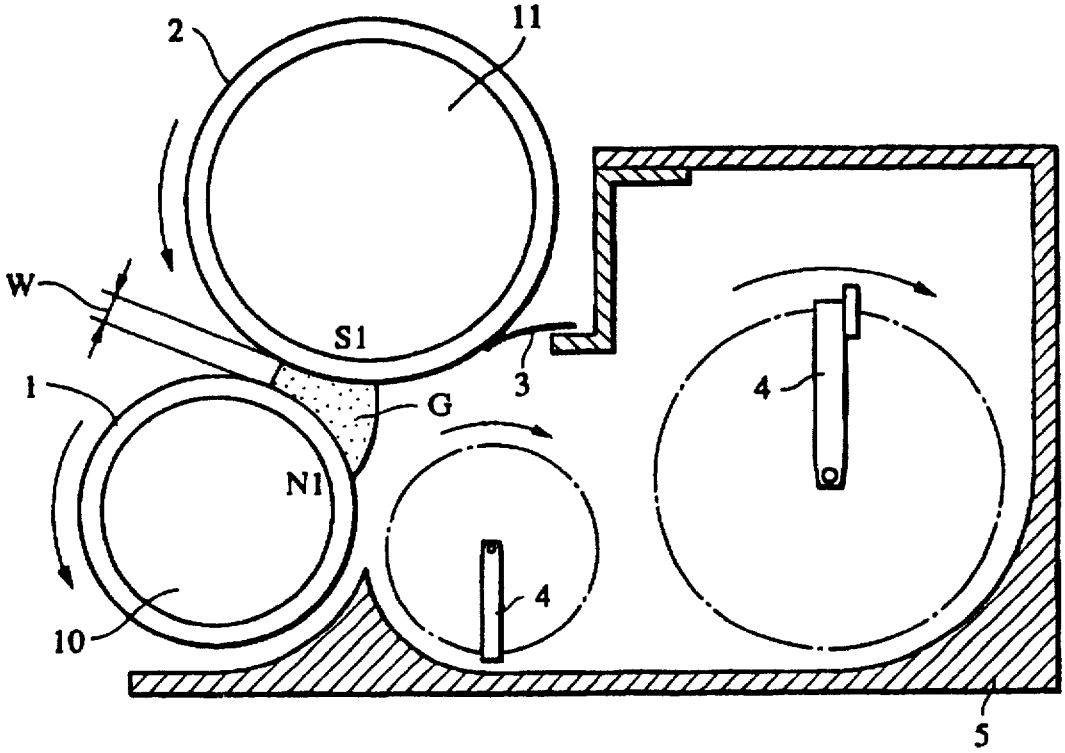
FIG. 10 is a schematic diagram showing the construction of still another embodiment of the present invention.
Figure 11:
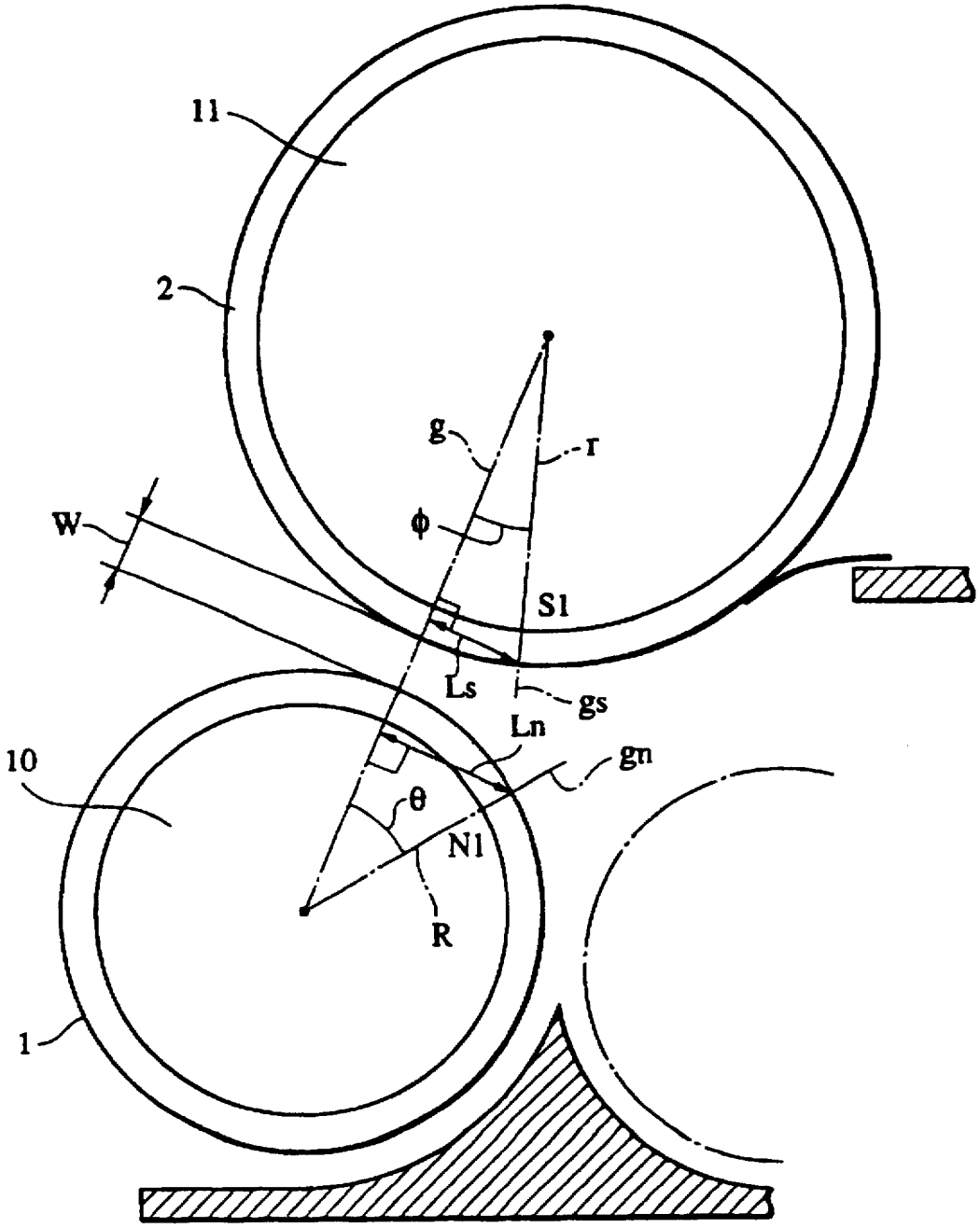
FIG. 11 is a diagram showing optimal disposition of the magnet in the development sleeve and the magnet in the regulating sleeve in the development apparatus shown in FIG. 10.

FIG. 10 is a schematic diagram showing the construction of a development apparatus which represents a third embodiment of the present invention, and FIG. 11 is a diagram for explaining optimal magnetic pole disposition of a magnet in the development sleeve 1 and a magnet in a regulating sleeve 2 in a development apparatus shown in FIG. 5.

The development apparatus of this embodiment is characterized in that a regulating sleeve 2 is larger in diameter than a development sleeve 1, such relationship being reverse to that in Embodiment 2, and that a magnetic pole N1 of a magnet 10 and a magnetic pole S1 of a magnet 11 cooperating to produce a magnetic field forming a restraining region G are placed in a particular positional relationship with each other in order for charging a magnetic toner and selectively applying a sufficiently-charged part of the toner on the development sleeve 1 to be compatible with each other in the restraining region G.

The arrangement of this embodiment is intended to reduce the size of the development apparatus of Embodiment 1. In other respect, this embodiment is the same as Embodiment 1 shown in FIG. 1.

In this embodiment, the regulating sleeve 2 has an outside diameter of 20 mm while the development sleeve 1 has an outside diameter of 16 mm. The magnet 10 in the development sleeve 1 has four poles consisting of the magnetic pole N1 positioned in the vicinity of a portion of the development sleeve 1 opposed to the regulating sleeve 2 and other three magnetic poles (not shown). The magnet 11 in the regulating sleeve 2 has two poles consisting of the magnetic pole S1 positioned in the vicinity of a portion of the regulating sleeve 2 opposed to the development sleeve 1 and another magnetic pole (not shown).

A magnet with a magnetic pole N1 having a magnetic flux density of 800 gauss and a half-value width α of 45° was employed as magnet 10, and a magnet with a magnetic pole S1 having a magnetic flux density of 800 gauss and a half-value width α of 30° was employed as magnet 11.

In this development apparatus, the magnetic pole N1 is positioned so that at the angle θ is within the range expressed by inequality (1): $0<\theta\leqq\alpha/2$. If the magnetic pole N1 is positioned so that $\theta>\alpha/2$, the magnetic pole N1 cannot suitably cooperate with the magnetic pole S1 to form a magnetic field strong enough to form the restraining region G. If $\theta\leqq 0$, the magnetic pole N1 is positioned on the downstream side of the position of opposition to the regulating sleeve 2 in the developer transport direction, so that the toner transported to the restraining region G is returned to an inner section of the development case 5 by the reverse transport force from the regulating sleeve 2 before being triboelectrically charged by friction with the development sleeve 1, resulting in failure to apply the toner on the development sleeve 1.

Also, in order for charging the magnetic toner and selectively applying a part of the magnetic toner sufficiently charged on the development sleeve 1 to be compatible with each other in the restraining region G, the magnetic pole S1 is positioned so that, referring to FIG. 11, the distances Ln and Ls satisfy $(0\leqq)\ Ls\leqq Ln$, that is, the magnetic pole S1 is positioned at the angle ϕ satisfying the following inequality (2):

$$0<r\cdot\sin\phi\leqq R\cdot\sin\theta \quad (2)$$

Figure 12A:
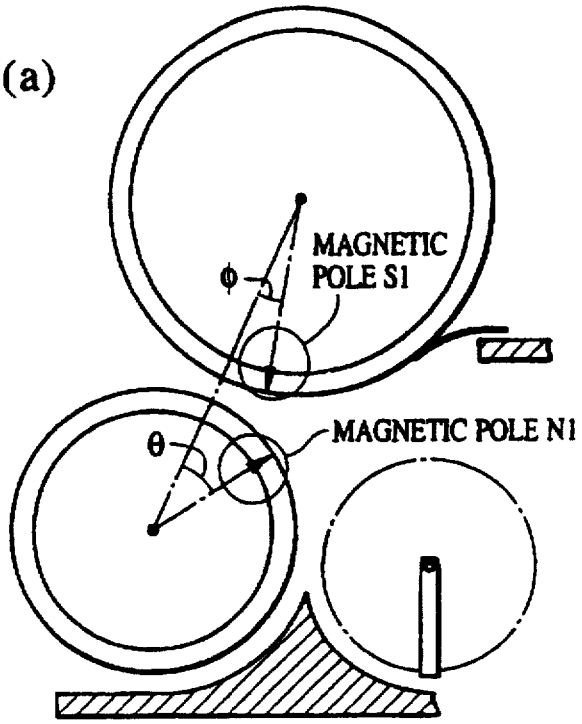
FIG. 12(*a*) is a diagram showing the relationship between magnetic pole N1 of the magnet in the development sleeve and magnetic pole S1 of the magnet in the regulating sleeve placed in optimal positions.
Figure 12B:
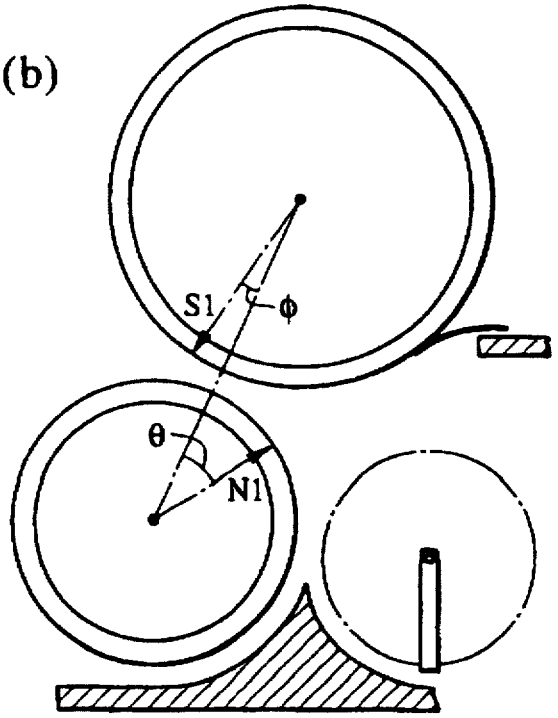

FIG. 12(*a*) shows the relationship between the positions of the magnetic pole N1 and the magnetic pole S1 in this development apparatus, and FIGS. 12(*b*), 13(*a*), and 13(*b*) show other positional relationships as comparative examples.

The positional relationship A shown in FIG. 12(*a*) set in this development apparatus is such that the magnetic pole N1 is positioned so that the angle θ is within the range of ½ of the angle α of the magnetic pole N1 half-value width, and such that the magnetic poles N1 and S1 are positioned on the upstream side of the opposed portions of the development sleeve 1 and the regulating sleeve 2 in the toner transport direction but the magnetic pole S1 is positioned downstream relative to the magnetic pole N1.

In the case where the positional relationship A was established, both the performance of charging the toner and the applied state of the toner were good. It is thought that the magnetic field formed by cooperation of the magnetic poles N1 and S1 is optimized by the positional relationship A, so that the toner can be restrained strongly enough to be suitably charged, and so that the transport forces to the restrained toner from the development sleeve 1 and the regulating sleeve 2 are suitably balanced to selectively apply the toner. Thus, certain compatibility is accomplished between charging the toner and selectively applying the sufficiently-charged toner on the development sleeve.

The positional relationship B shown in FIG. 12(*b*) is a comparative example which differs from the positional relationship A in that the magnetic pole S1 is positioned on the downstream side of the opposed portions of the development sleeve 1 and the regulating sleeve 2 in the toner transport direction. In the case where the positional relationship B was established, both the performance of charging the toner and the applied state of the toner were unsatisfactory. With respect to this result, it is thought that, since the magnetic pole S1 is positioned on the downstream side of the opposed portions, the restraint of the toner decreases abruptly in a downstream portion of the formed restraining region G to fail to restrain a portion of the toner from leaking onto the development sleeve 1.

Figure 13A:
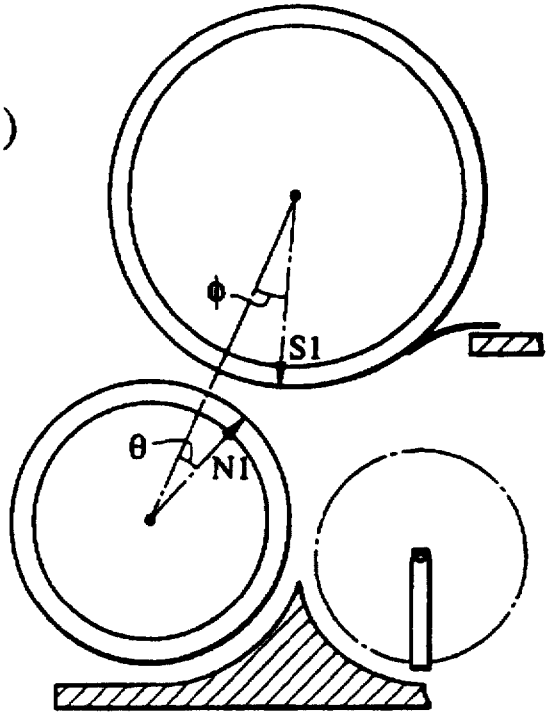
Figure 13B:
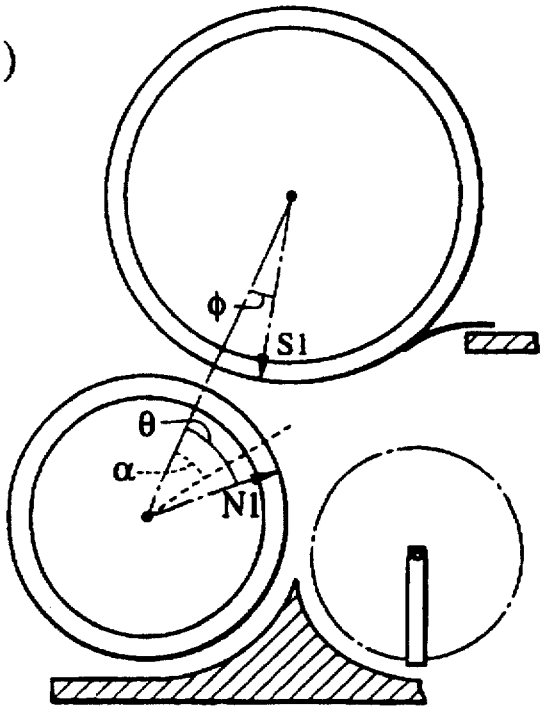

The positional relationship C shown in FIG. 13(*a*) is a comparative example in which the positions of the magnetic poles N1 and S1 in the positional relationship A are reversed to set the magnetic pole S1 upstream relative to the magnetic pole N1. In the case where the positional relationship C was established, both the performance of charging the toner and the applied state of the toner were unsatisfactory. With respect to this, it is thought that the reverse transport force acting on the toner is so strong in an upstream portion of the restraining region G that the toner is returned in the direction toward an inner section of the development case 5 before being sufficiently charged triboelectrically by friction with the surface of the development sleeve 1, resulting in a reduction in the amount of applied toner as well as failure to sufficiently charge the toner.

The positional relationship D shown in FIG. 13(*b*) is a comparative example which differs from the positional relationship A in that the magnetic pole N1 is positioned so that the angle $\theta$ is outside the range of ½ of the angle $\alpha$ of the magnetic pole N1 half-value width. In the case where the positional relationship D was established, both the performance of charging the toner and the applied state of the toner were unsatisfactory for the same reason as described above.

As described above, in this development apparatus, the magnetic pole N1 is positioned at the angle $\theta$ satisfying inequality (1):

$$0<\theta\leq\alpha/2 \quad (1)$$

while the magnetic pole S1 is positioned at the angle $\phi$ satisfying inequality (2):

$$0<r\cdot\sin\phi\leq R\cdot\sin\theta. \quad (2)$$

The magnetic field formed by the magnetic poles N1 and S1 in cooperation with each other is thereby optimized, so that charging the magnetic toner and selectively applying the sufficiently-charged toner on the development sleeve 1 are compatible with each other in the restraining region G.

Further, the regulating sleeve 2 is increased in diameter relative to the development sleeve 1 to achieve uniformity in the applied state of the toner so that image formation can be stably performed, as explained below.

In this development apparatus, the selective application of the toner is performed by using the transport force from the development sleeve 1 due to an image force and the reverse transport force from the regulating sleeve due to the restraint with the magnetic field formed by the magnetic pole S1. To improve the uniformity and stability of selective application, therefore, it is important to stabilize the performance of charging the toner. This requires stabilization of the restraining region G.

However, in a situation where the diameters of the development sleeve 1 and the regulating sleeve 2 are reduced for a reduction in the overall size of the development apparatus, it is difficult to provide the magnet 10 with a magnetic pole having a large magnetic flux density because of size limitations of the magnet 10. Therefore, it is difficult to stabilize the restraining region G by increasing the magnetic flux density of the magnetic field forming the restraining region G.

Further, in the restraining region G formed along portions of the small-diameter development sleeve 1 and the regulating sleeve 2 facing each other, the amount of toner restrained in the region G is limited because of a spatial restriction on the restraining region G. Accordingly, even a small variation in the rate of toner supply to the restraining region G has a large influence upon the restraining region G and can easily make the restraining region G unstable. Such a variation may be caused if the toner is consumed at a higher rate by continuous image formation or if a non-uniformity in the longitudinal direction of the development sleeve occurs in the rate of supply of the toner from the development case 5 to the development sleeve.

In the development apparatus of this embodiment, the regulating sleeve 2 is increased in diameter relative to the development sleeve 1 to increase the toner restraining region G. In this manner, the amount of toner restrained in the restraining region G can be increased.

Figure 14A:
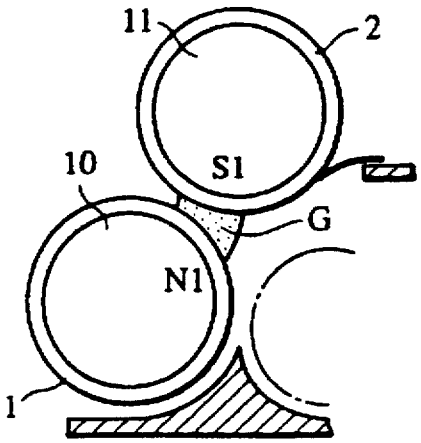
FIGS. 14(*a*) to 14(*c*) are enlarged diagrams showing the size of restraining region G with respect to combinations of the outside diameters of the development sleeve and the regulating sleeve.
Figure 14B:
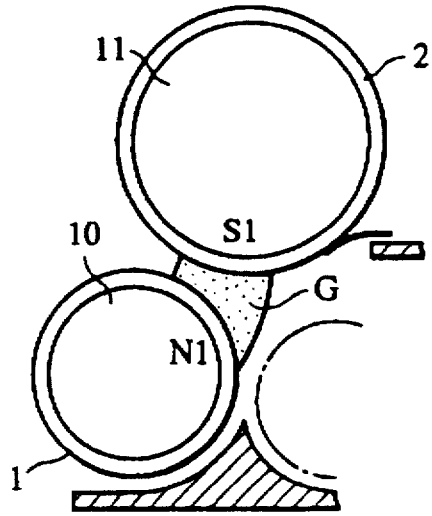
Figure 14C:
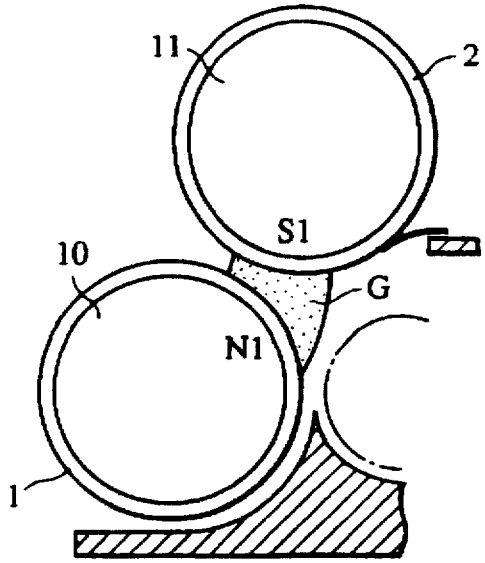

FIGS. 14(*a*) to 14(*c*) are enlarged diagrams of restraining regions G corresponding to three combinations of development and regulating sleeves. FIG. 14(*a*) shows a comparative example in which a development sleeve 1 and a regulating sleeves 2 each having an outside diameter of 16 mm were used. FIG. 14(*b*) shows an example of the development apparatus of this embodiment in which a development sleeve 1 having an outside diameter of 16 mm and a regulating sleeve 2 having an outside diameter of 20 mm were used. FIG. 14(*c*) shows a comparative example in which a development sleeve 1 and a regulating sleeves 2 each having an outside diameter of 20 mm were used.

As can be seen in these figures, the development apparatus of this embodiment can form a restraining region G substantially equal to that formed by using the development and regulating sleeves each having an outside diameter of 20 mm. Thus, even if small-diameter development and regulating sleeves are used, the restraining region G can be stabilized, thereby making the applied state of the toner uniform for stable image formation.

This arrangement is particularly advantageous if a small-diameter development sleeve is used.

The embodiments of the invention have been described with respect to the case of using a one-component magnetic developer (magnetic toner). However, the present invention is not limited to this and has the same advantages with respect to various magnetic developers.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structure and functions.

What is claimed is:

1. A development apparatus comprising:

a developer carrier member for carrying and transporting a magnetic developer;

a regulating rotary member for controlling the thickness of a layer of the developer on said developer carrier member;

a first magnetic pole provided in said developer carrier member in the vicinity of a regulating portion of said regulating rotary member; and a second magnetic pole provided in said regulating rotary member to form a magnetic field for restraining the developer in cooperation with said first magnetic pole, wherein said first and second magnetic poles are provided on the upstream side of a straight line connecting a center of said developer carrier member and a center of said regulating rotary member in the direction of transport of the developer by said developer carrier member so that the following inequalities are satisfied:

$$0<\theta\leqq\alpha/2$$

$$0\leqq r\cdot\sin\phi<R\cdot\sin\theta$$

where $\alpha$ is an angle of a half-value width of a magnetic flux density distribution of said first magnetic pole; $\theta$ is an angle between a line connecting said first magnetic pole and the center of said developer carrier member and the straight line connecting the centers of said developer carrier member and said regulating rotary member; $\phi$ is an angle between a line connecting said second magnetic pole and the center of said regulating rotary member and the straight line connecting the centers of said developer carrier member and said regulating rotary member; r is a radius of said regulating rotary member; and R is a radius of said developer carrier member.

2. A development apparatus according to claim 1, wherein the developer comprises a magnetic toner.

3. A development apparatus according to claim 1, wherein said regulating rotary member rotates in a direction opposite to the direction in which the developer is transported by said developer carrier member in a restraining region.

4. A development apparatus according to claim 1, wherein $\theta>\phi$.

5. A development apparatus according to claim 1, wherein the developer is triboelectrically charged by friction with said developer carrier member.

6. A development apparatus according to claim 1, wherein a gap exists between said developer carrier member and said regulating rotary member.

* * * * *

UNITED STATES PATENT AND TRADEMARK OFFICE

CERTIFICATE OF CORRECTION

PATENT NO. : 5,754,929
DATED : May 19, 1998
INVENTOR(S) : Nonomura et al.

It is certified that error appears in the above-identified patent and that said Letters Patent is hereby corrected as shown below:

Item [57] ABSTRACT,
Line 15, "$0 \leq r.\sin\phi < R\cdot \sin\theta$" should read -- $0 < r\cdot \sin\phi \leq R\cdot \sin\theta$ --.

Column 1,
Line 49, "non-rotatably" should read -- nonrotatably --.

Column 2,
Line 4, "particles" should read -- particules that are --.

Column 3,
Line 21, "electric" should read -- an electric --.
Line 36, "sleeve 1" should read -- sleeve 1, --.

Column 4,
Line 44, "$0 \leq r.\sin\phi < R\cdot \sin\theta$" should read -- $0 < r\cdot \sin\phi \leq R\cdot \sin\theta$ --.
Line 63, "apparatus" should read -- apparatus, --.

Column 6,
Line 3, "apparatus" should read -- apparatus, --.
Line 9, "non-magnetic" should read -- nonmagnetic --.

Column 9,
Line 20, "example" should read -- example, --.

Column 11,
Line 13, "other" should read -- the other --.

Column 12,
Line 39, "example" should read -- example, --.

UNITED STATES PATENT AND TRADEMARK OFFICE

CERTIFICATE OF CORRECTION

PATENT NO. : 5,754,929
DATED : May 19, 1998
INVENTOR(S) : Monomura et al.

It is certified that error appears in the above-identified patent and that said Letters Patent is hereby corrected as shown below:

Column 18,
Line 2, "$0 \leq r.\sin\phi < R\cdot \sin\theta$" should read -- $0 < r\cdot \sin\theta \leq R\cdot \sin\theta$ --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*